US007182594B1

(12) United States Patent
Malafouris

(10) Patent No.: US 7,182,594 B1
(45) Date of Patent: Feb. 27, 2007

(54) BURNER ASSEMBLY FOR FIREPLACE LOGS AND METHOD OF USING SAME

(76) Inventor: Dannie O. Malafouris, P.O. Box 13637, Portland, OR (US) 97213

( * ) Notice: Subject to any disclaimer, the term of this patent is extended or adjusted under 35 U.S.C. 154(b) by 0 days.

(21) Appl. No.: 11/350,607

(22) Filed: Feb. 8, 2006

(51) Int. Cl.
*F23D 14/46* (2006.01)
*F23C 3/00* (2006.01)

(52) U.S. Cl. ..... 431/350; 431/249; 126/512

(58) Field of Classification Search ..... 431/350, 431/125, 249, 251, 338, 339, 340; 126/512
See application file for complete search history.

(56) References Cited

U.S. PATENT DOCUMENTS 6,036,474 A * 3/2000 Diep et al. ..... 431/125

* cited by examiner

*Primary Examiner*—Alfred Basichas
(74) *Attorney, Agent, or Firm*—Chernoff, Vilhauer, McClung & Stenzel, LLP

(57) ABSTRACT

A burner for use with fireplace gas logs includes a burner pan having a gas burner extending across it. A flame control plate is located in the burner pan above the burner. The flame control plate has an opening located in it which is partially covered by a damper. The damper can be moved to cover various portions of the opening which allows directing the burner flame to give the desired effect in the fireplace logs. By installing the burner assembly in a particular manner the fireplace logs can be made to look substantially like real burning logs.

10 Claims, 8 Drawing Sheets

BURNER ASSEMBLY FOR FIREPLACE LOGS AND METHOD OF USING SAME

BACKGROUND OF THE INVENTION

The subject invention relates to a burner assembly for use with ceramic fireplace gas logs, and to a method of constructing a log set on the burner assembly in a manner that provides a more natural appearance when burning.

Fireplace logs are often used in fireplaces or fire pits to give the appearance of real logs. A burner pan having a burner which burns natural gas or propane is placed under the fireplace logs to create a flame which passes through the logs to give them the appearance and effect of burning wood. While the logs themselves are quite realistic, the manner in which the logs are installed typically does not create a realistic appearance when the logs are burning. In addition, prior art fireplace logs are installed in a manner such that most of the flame is at the back or center of the logs where it provides little radiant heat.

SUMMARY OF THE INVENTION

The subject invention overcomes the shortcoming of the prior art fireplace logs by providing a burner assembly for fireplace log sets having a burner pan with a burner extending across it and a flame control plate which is located in the burner pan above the burner. The flame control plate has an opening, a portion of which can be selectively closed with a damper. The invention also covers a method for using this burner assembly to make fireplace logs look like real logs when burning.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
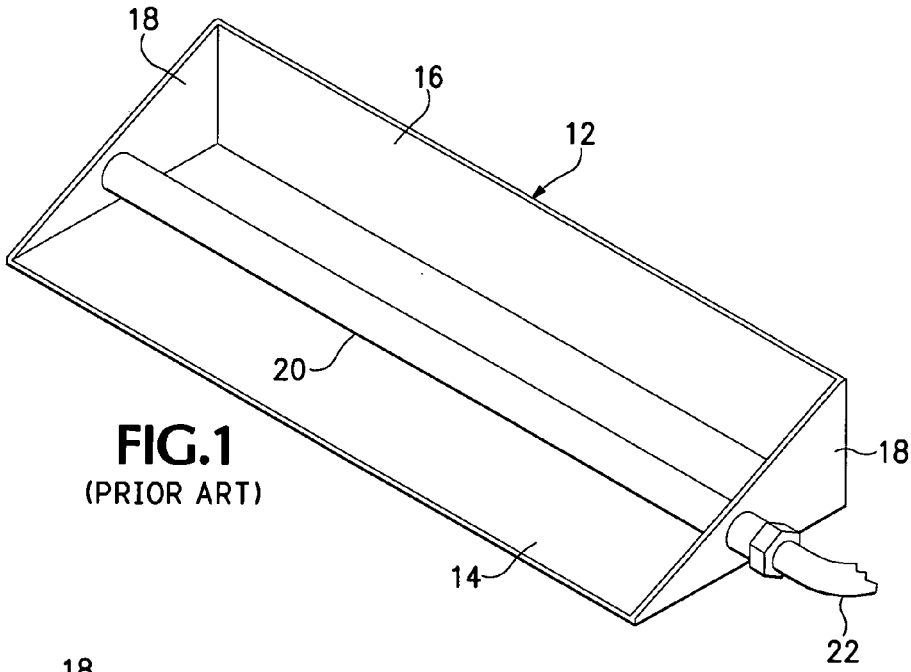
FIG.1 (PRIOR ART)
FIG. 1 is a perspective view of a prior art burner pan.

A burner assembly 10 includes a burner pan 12 having a planar rectangular base 14 with an upright rectangular back 16 and opposed upright triangular sides 18. A burner 20, which extends across the burner pan, is connected to a source of burnable gas, such as natural gas or propane (not shown), through a supply pipe 22. A series of holes (not shown) located in the bottom of the burner allow the gas to flow out of the burner along its entire length. As shown in FIG. 1, burner pans of this type are well known in the prior art. The exact shape of the burner pan can vary and other shapes can be used. The size of the burner pan will vary based on the application. Burner pans of this type are used to supply a distributed flame along their extent for burning fireplace logs in fireplaces, inserts and open fire pits.

Figure 2:
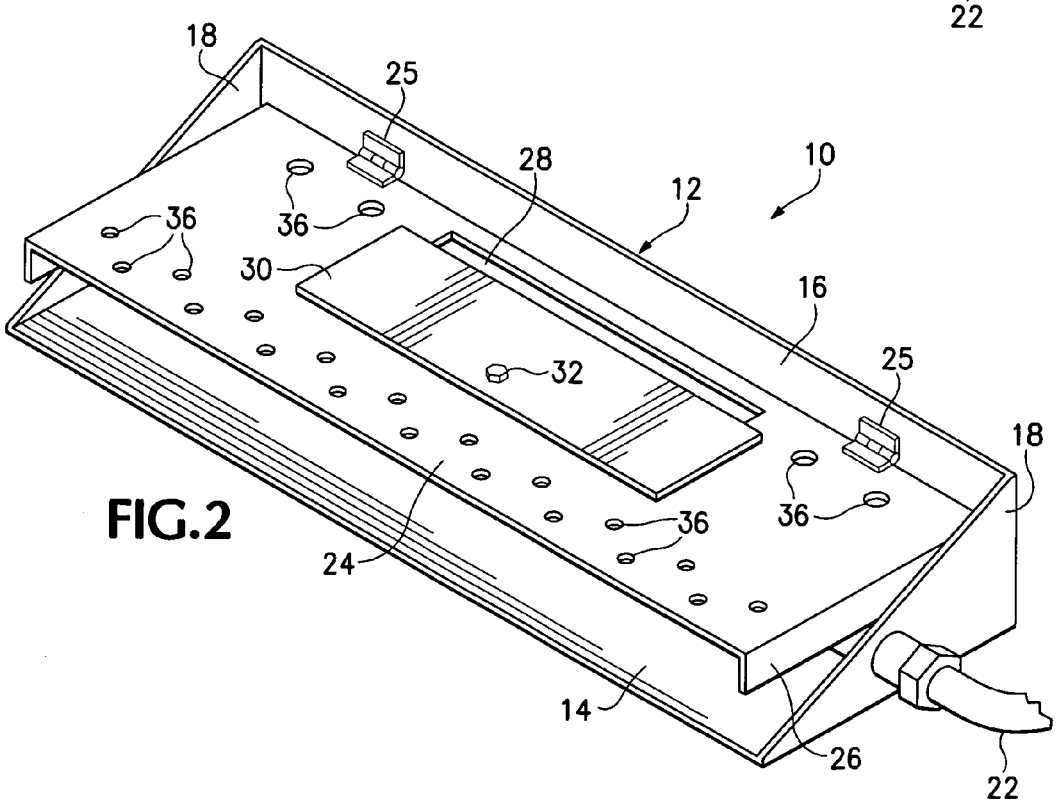
FIG. 2 is a perspective view of the burner assembly of the subject invention with the flame control plate in its closed or operative position.
Figure 3:
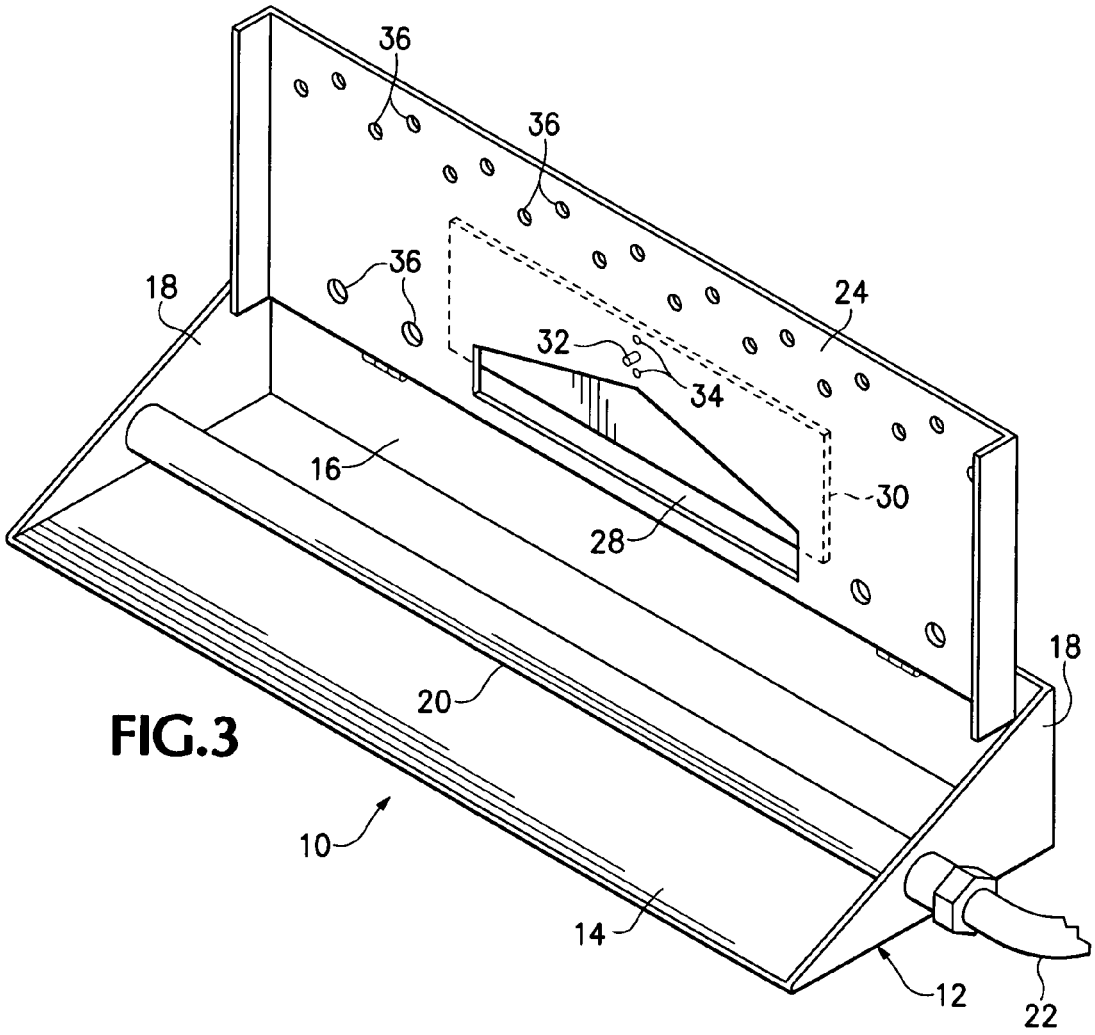
FIG. 3 is a perspective view of the burner assembly of FIG. 2 with the flame control plate rotated to an open position.

Referring now to FIGS. 2 and 3, located in the burner pan 12 is a flame control plate 24. The flame control plate is shown as rectangular but could have other shapes depending on the shape of the burner pan it is installed in. The flame control plate is attached to the back 16 of the burner pan by a pair of hinges 25 which allows it to be rotated between an operable position, FIG. 2, where it extends over the burner 20, and a raised position, FIG. 3, where the burner 20 is exposed. The flame control plate illustrated has legs 26 which depend from each of its ends and cause it to be positioned slightly above the burner when it is in its operating position.

Figure 4:
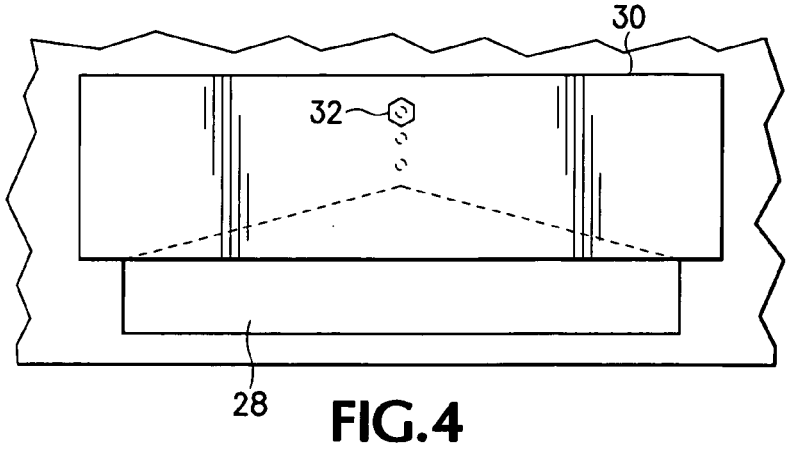
FIGS. 4–6 show how the damper can be adjusted to cover varying portions of the opening in the flame control plate.
Figure 5:
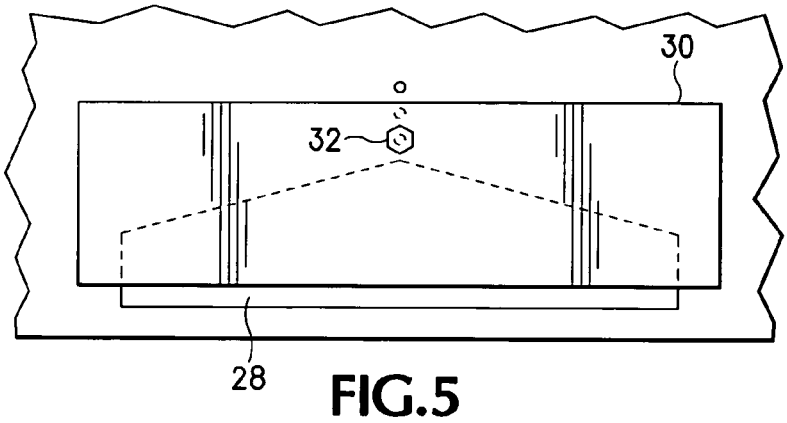
Figure 6:
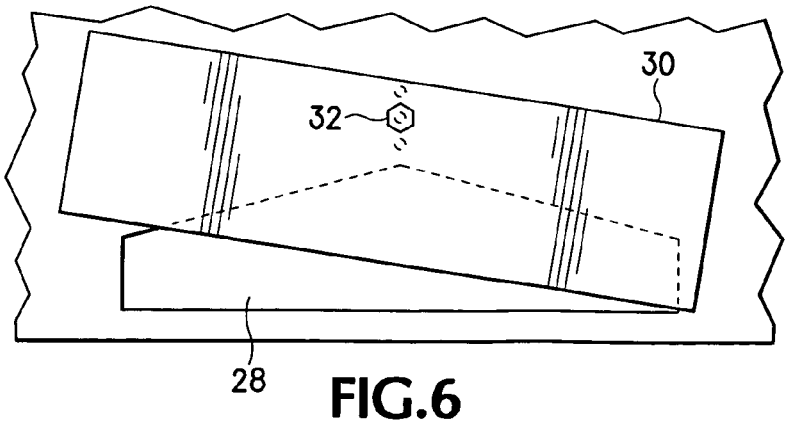

Located in the rear center portion of the flame control plate is an opening 28. The opening 28 is preferably located mostly behind the burner 20, but the front edge of the opening can extend over or slightly in front of the burner. In the embodiment illustrated the opening is elongate and is progressively wider moving toward its center. A damper 30, which is releasably mounted to the flame control plate, partially covers the opening 28. In the embodiment illustrated the damper is rectangular, but its shape could vary depending on the shape of the opening and the shape of the flame control plate. The damper is attached to the flame control plate by a screw 32 which fits loosely through a hole (not shown) in the damper and threads into one of a series of holes 34 in the flame control plate. The holes 34 are located forwardly of the center of the opening 28. By having multiple holes 34 the amount of the opening covered by the damper, and the amount of flame positions through the log set, can be varied as shown in FIGS. 4 and 5. This allows varying the location of the flame front to rear on the log set. Having a single attachment point through the screw 32 allows the damper to be rotated about the screw and have more open area on one side of the opening than the other as shown in FIG. 6. This adjustment in conjunction to the opening 28 becoming progressively wider moving toward its center allows varying the location of the flame side to side along the log set to create a natural-appearing burn and to overcome a tendency of the flame to primarily be on one side.

Also located in the flame control plate are a series of small openings 36 which are located around the opening 28. The small openings 36 are located on each side and in front of the opening 28 to allow some of the flame to extend across the entire log set. However, because the opening 28 is much larger than the openings 36, the majority of the flame will be at the center of the logs, as it is with real wood logs.

Figure 7:
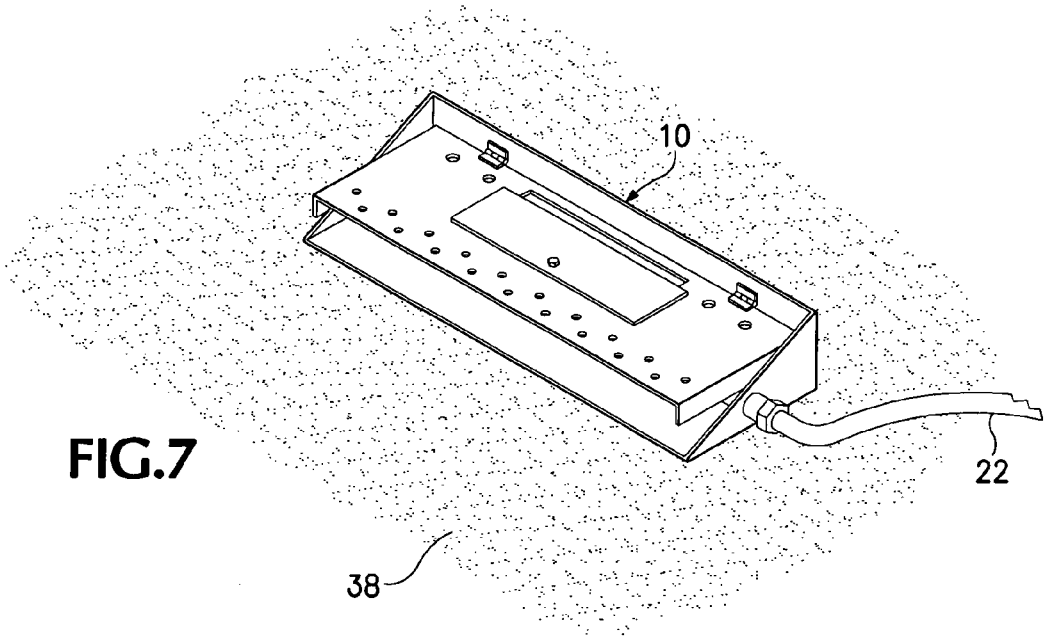
FIGS. 7–13 show the method of installing a fireplace log set over the burner assembly of FIG. 2.

Referring now to FIG. 4, before the burner assembly 10 is placed on a burning surface sand 38 is spread on top of the burning surface. The sand creates a base which prevents the burner assembly from moving around. After the burner assembly is in place and the supply pipe 22 has been connected to a source of burnable fuel, the burner assembly and the area surrounding the burner assembly are filled with vermiculite 40 or a similar material, FIG. 5. A grate 42 is then placed over the burner assembly. More vermiculite 40 is placed on and around the burner assembly to completely cover the burner assembly and to partially cover the grate, primarily its front portion, FIG. 7.

Figure 8:
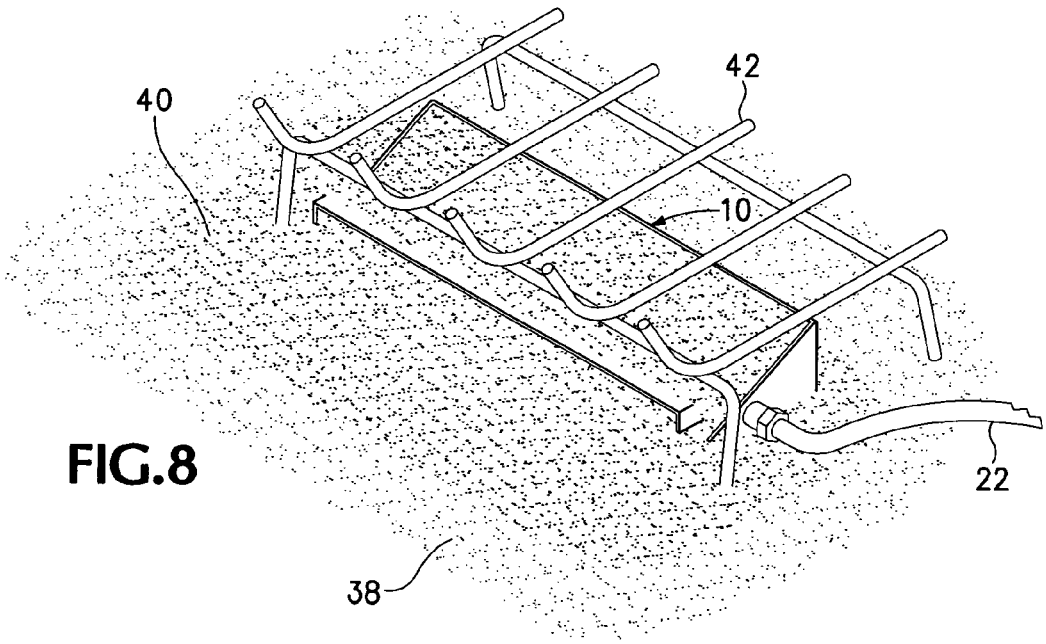

The vermiculite is then covered with a thin layer of zonalite 44. The front of the grate 42 is then covered with a layer of thermal fiber 46, FIG. 7, and the fireplace log set 48 is built on the grate 42, FIG. 8.

Figure 9:
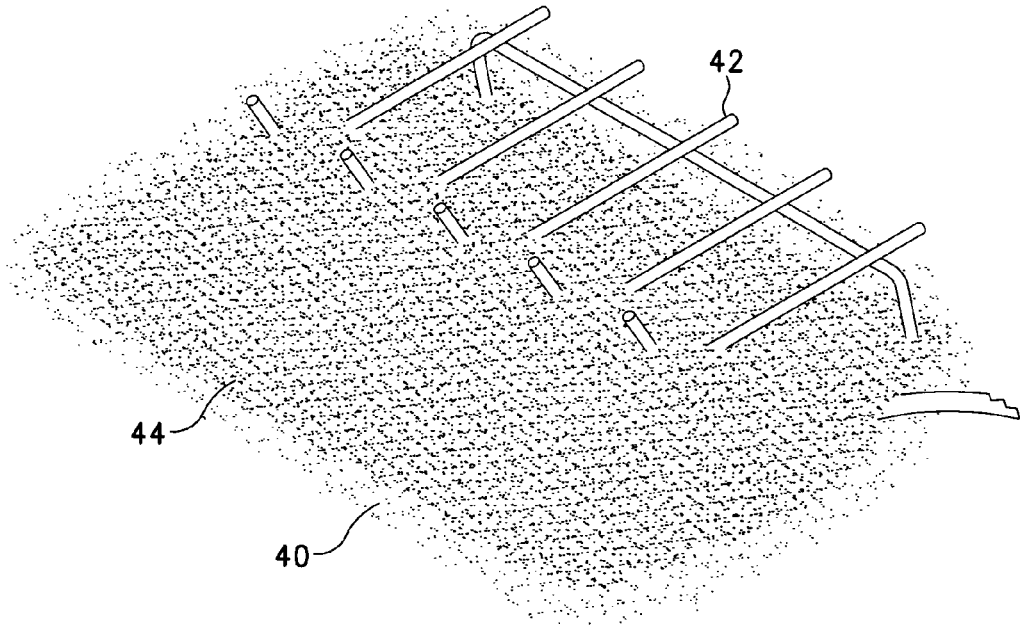
Figure 10:
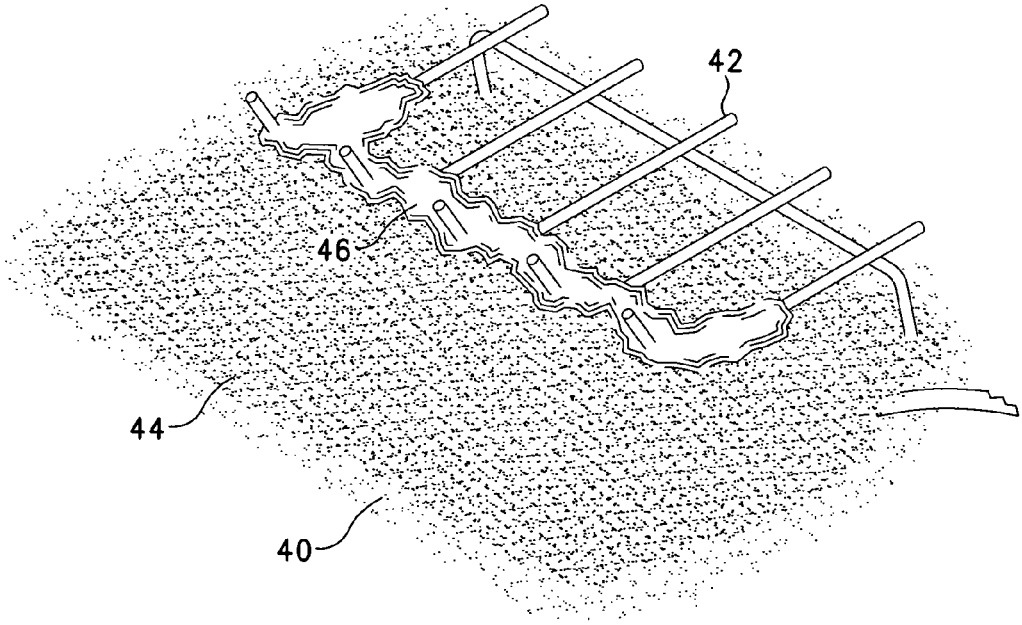
Figure 11:
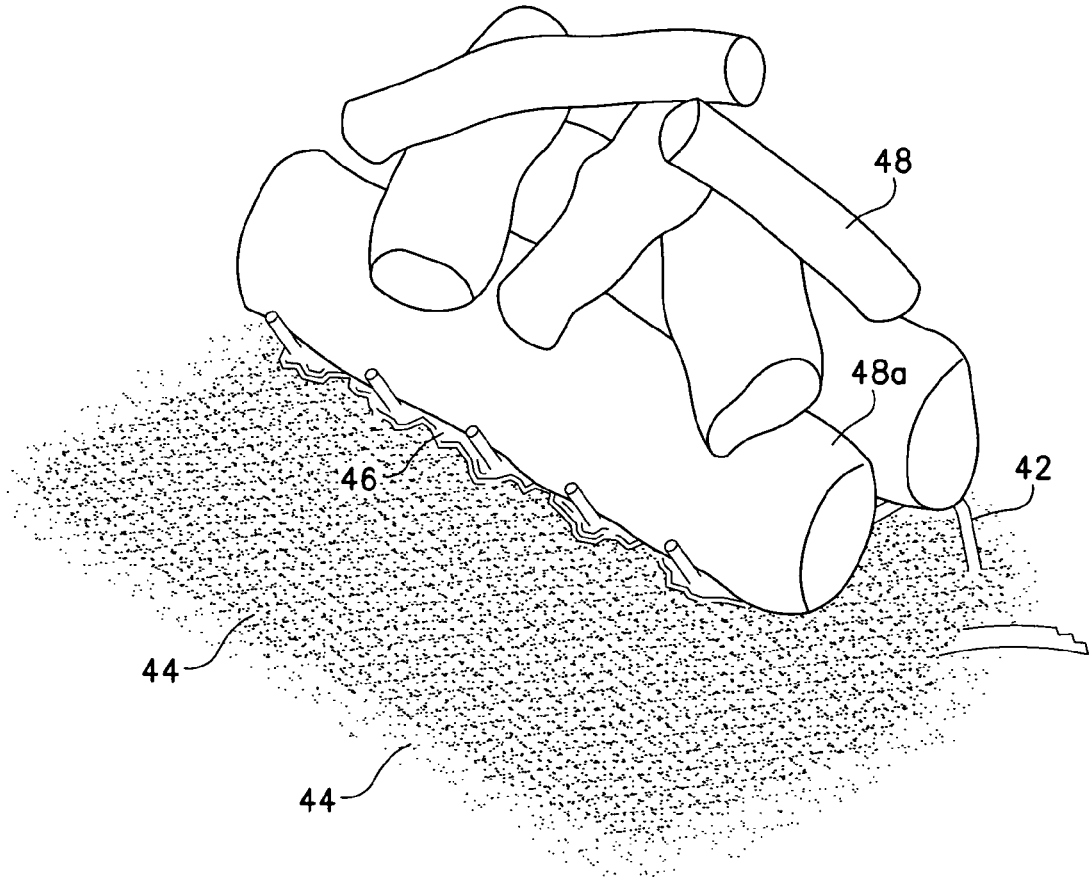
Figure 12:
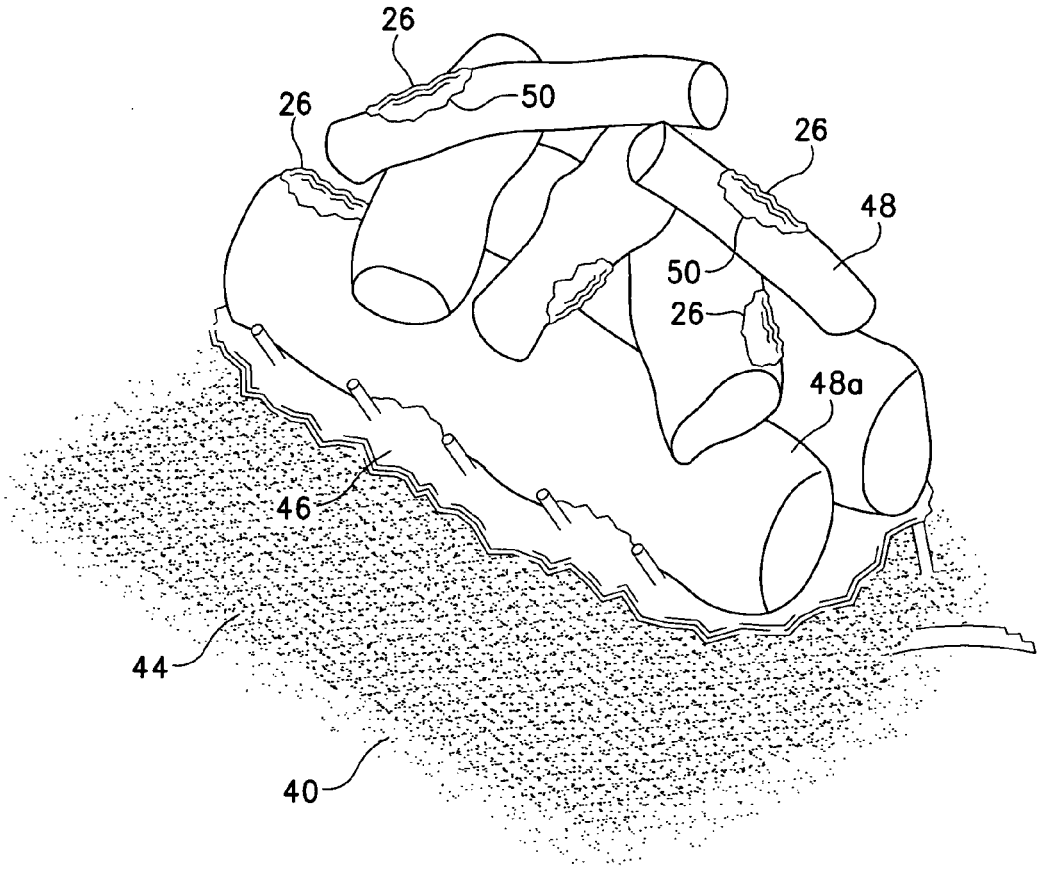
Figure 13:
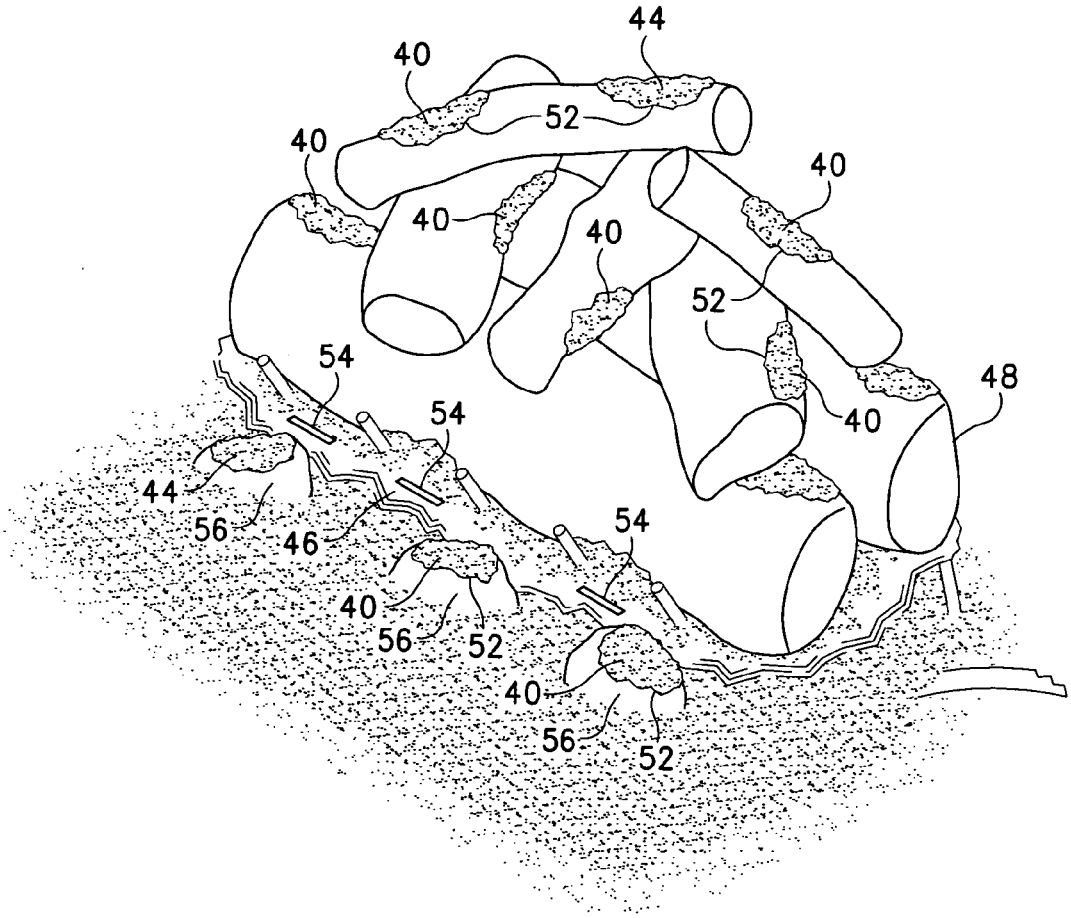

Once the log set 48 has been built on the grate 42, more thermal fiber 46 is used to cover any openings between the lower front log 48*a* and the vermiculite/zonalite base. A pitch-like glue 50 can be applied to selected locations on the fireplace logs and more thermal fiber 46 adhered to the glue, FIG. 9. The thermal fiber 42 on the logs is then painted with a high temperature paint 52, which preferably is black or a dark color which appears essentially black, and vermiculite 40 and/or zonalite 44 is placed on top of the paint before it dries, FIG. 10. Openings 54 no more than ½ inch wide are cut in the thermal fiber 46 located at the front of the bottom log 48 with a knife or other sharp object to allow a small amount of the flame to go in front of the logs and create an ember effect.

Decorative rock 56 can be placed in front of the log set. If desired, the rock can be covered with paint 52 and vermiculite 40 and/or zonalite 42 can be applied to the paint before it dries. The burner is then lit to see how the flame penetrates the log set, and, if necessary, the damper 30 can be adjusted to create the desired flame pattern.

The purpose of the burner assembly and the method of installing it is to force the flame toward the front and center of the logs where more of the heat generated by the flame will be radiated into the room. With the prior art most of the flame is at the back or center of the logs and the majority of the heat it generates is lost up the chimney. The legs 26 cause the front of the flame control plate to be raised so that more of the flame will be at the front of the logs. However, this alone would cause a large portion of the draft caused by the burning fireplace to be drawn under the logs which would tend to negate the effect of the flame being forced to the front of the log set. Thus, it is important that the vermiculite 40 and thermal fiber 46 completely cover any open space at the front of the logs with only the small openings 34 in the thermal fiber to create an ember effect below the logs.

When heated the thermal fiber covered with vermiculite and/or zonalite glows much like ambers on real burning logs, giving an appearance of natural burning logs. In addition it allows the flame to pass almost completely through the logs rather than around them, which creates the appearance of real burning logs. The overall result is that when burning the log set appears far more realistic than is normally the case with fireplace logs.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A burner assembly for use with a fireplace log set comprising:

(a) a burner pan;

(b) a burner which extends across said burner pan;

(c) a flame control plate which is located in said burner pan above said burner;

(d) said flame control plate having at least one opening defined therein;

(e) a damper which is selectively positionable to cover a portion of said opening;

(f) wherein said damper is moveable to cover different portions of said opening.

2. The burner assembly of claim 1 wherein said opening is an elongate slot having a center and opposed ends, and said damper is plate which is releasably attached to said flame control plate in a manner which allows it to cover varying portions of said opening.

3. The burner assembly of claim 2 wherein said damper is attached to said flame control plate in a manner such that it can be moved to cover one end of said opening more than it covers the opposed end.

4. The burner assembly of claim 2 wherein said opening has a length and a width and said width becomes progressively larger moving toward the center of said opening.

5. The burner assembly of claim 4 wherein said damper is attached to said flame control plate at a single attachment point.

6. The burner assembly of claim 5 wherein said attachment point is proximate the center of said opening and said damper can be rotated about said attachment point.

7. The burner assembly of claim 5 wherein said attachment point can be at multiple locations relative to said opening.

8. The burner assembly of claim 5 wherein said damper is attached to said flame control plate by a screw which extends through a hole in said damper into a threaded opening in said flame control plate.

9. The burner assembly of claim 1 wherein said flame control plate is rotatably attached to said burner pan in a manner which allows it to be raised to provide access to said burner pan.

10. The burner assembly of claim 1 wherein a plurality of holes are defined in said plate around said opening.

* * * * *

UNITED STATES PATENT AND TRADEMARK OFFICE

CERTIFICATE OF CORRECTION

PATENT NO. : 7,182,594 B1
APPLICATION NO. : 11/350607
DATED : February 27, 2007
INVENTOR(S) : Dannie O. Malafouris It is certified that error appears in the above-identified patent and that said Letters Patent is hereby corrected as shown below:

Column 4, Line 18. Claim 2: Please add an "a" between the words "is" and "plate."

Signed and Sealed this

Seventh Day of August, 2007

JON W. DUDAS
*Director of the United States Patent and Trademark Office*